United States Patent [19]

Cohen et al.

[11] Patent Number: 5,040,446

[45] Date of Patent: Aug. 20, 1991

[54] TAMBOURINE

[75] Inventors: Wayne E. Cohen, Pomona, N.Y.; Donald Kralik, Garfield, N.J.

[73] Assignee: Latin Percussion, Inc., Garfield, N.J.

[21] Appl. No.: 641,454

[22] Filed: Jan. 14, 1991

[51] Int. Cl.[5] ..... G10D 13/02

[52] U.S. Cl. ..... 84/418

[58] Field of Search ..... 84/418

[56] References Cited

U.S. PATENT DOCUMENTS

| | | | |
|---|---|---|---|
| 1,434,278 | 10/1922 | Barry | 84/418 |
| 1,576,443 | 3/1926 | McElhany | 84/418 |
| 3,481,239 | 12/1969 | Blumenfeld | 84/418 |
| 3,675,528 | 7/1972 | Brick | 84/418 |
| 4,230,015 | 10/1980 | Taninbaum | 84/418 |
| 4,346,637 | 8/1982 | Janszen | 84/418 |

*Primary Examiner*—Lawrence R. Franklin

*Attorney, Agent, or Firm*—Brumbaugh, Graves, Donohue & Raymond

[57] ABSTRACT

A tambourine is fabricated from a single piece frame having two hinges which divide the frame into a central section and two end sections. As assembled the frame is bent at the hinges and curved so that the two end sections can be joined by a connecting member. The jingles are preferably mounted by grooves which intersect jingle slots and are arranged on opposite sides of the frame to retain the jingle mounting pin.

15 Claims, 3 Drawing Sheets

BEST AVAILABLE COPY

TAMBOURINE

BACKGROUND OF THE INVENTION

This invention relates to an improved construction for tambourines, and particularly relates to a tambourine having a plastic frame and an improved mounting arrangement for the jingles.

Conventional tambourines are fabricated with a circular frame of wood or similar material to which jingles are mounted, usually by the use of steel pins which extend through transverse bores in the frame, or nails, or driven screws through the frame, which intersect jingle slots in the frame. Vigorous play can cause the jingle pins, nails or screws to loosen and fall out.

It is an object of the present invention to provide a new and improved tambourine having a durable frame and an improved jingle arrangement to withstand vigorous playing.

SUMMARY OF THE INVENTION

In accordance with the invention there is provided a tambourine having jingle members mounted on a plastic frame. The frame is formed as an elongated web having two transverse hinges formed thereon which divide the frame longitudinally into a central frame section and two end frame sections. The frame is folded at the hinges and curved longitudinally with the frame ends being joined to a connecting member such that the frame is shaped into the form of intersecting arcs, one formed by the central frame section and the other formed by the connecting member and the end frame sections.

The hinges can be formed as transverse grooves on the web which divide the frame sections and may be provided with ridges on the surface of the web opposite the grooves to maintain material thickness for ease in molding. In one embodiment the connecting member is a contoured handle for holding the tambourine. In another embodiment the connecting member is a mounting bracket for mounting the tambourine, for example, to a drum stand. The transverse edge of the tambourine may be provided with a curved contour with an enlarged radius of curvature compared to the thickness of the frame to provide reinforcement to the frame, a larger surface to ease the impact on the player's hand and a larger surface for striking the tambourine with a drumstick. Alternatively, a cushioned edge strip may be provided.

In accordance with another aspect of the invention the jingles of a tambourine or other percussion musical instrument are mounted to a supporting frame having transversely adjacent slots. At least two grooves are provided on one side of the frame extending in a transverse direction and each intersecting one of the slots. At least one groove is provided on the other side of the frame which extends between and intersects two slots. The grooves are axially aligned and have depths selected to accommodate a pin passing through the grooves on both sides of the frame and the grooves have closed ends for retaining the ends of a pin with jingles mounted thereon.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
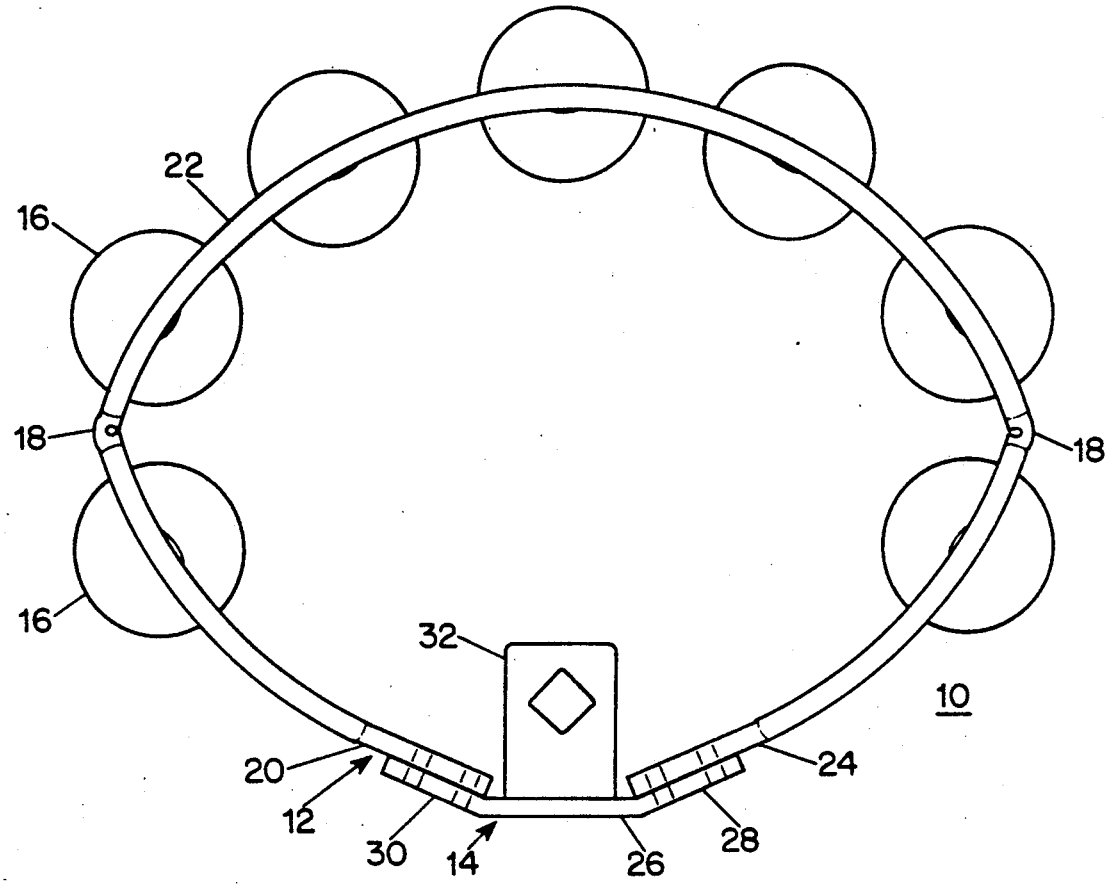
FIG. 1 is a top view of one embodiment of a tambourine according to the present invention.
Figure 2:
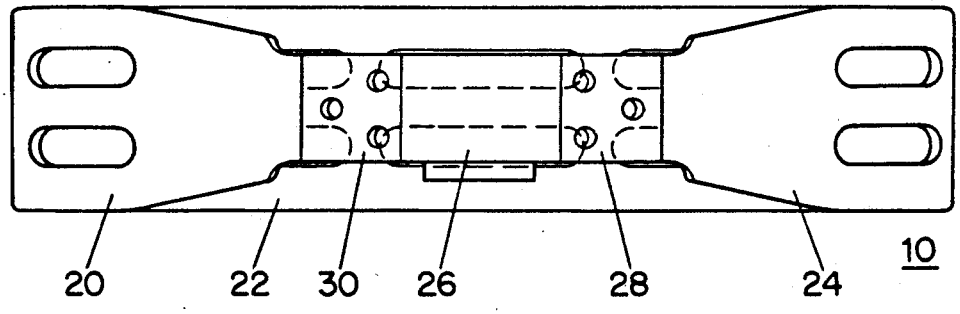
FIG. 2 is a rear view of the FIG. 1 tambourine.
Figure 3:
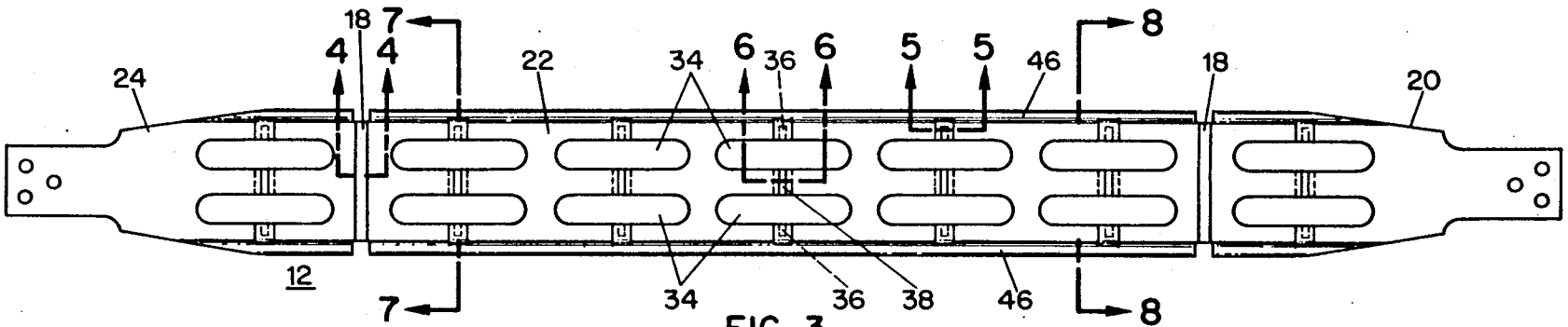
FIG. 3 is a plan view of the frame member for the FIG. 1 tambourine.
Figure 4:
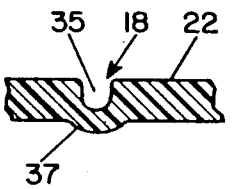
FIG. 4 is a detailed cross-sectional view of the FIG. 3 frame.

A tambourine 10 according to the present invention is shown in a top view in FIG. 1 and a rear view in FIG. 2. Tambourine 10 includes a frame member 12 which is fabricated in a single piece of suitable plastic material, such as nylon type 6/6 with Shore hardness D 65–70. Frame 12 is shown in plane view in FIG. 3 and consists of an elongated web of molded plastic having hinges 18 which divide the frame member into a central section 22 and end sections 20 and 24.

The assembled tambourine shown in FIG. 1 further includes a connecting member 14 which has flanges 28 and 30 jointed to the end sections 24 and 20 of frame 12. Central section 26 of connecting member 14 joins flanges 28 and 30 with a mounting member 32. Flanges 28 and 30 are angled with respect to each other and central section 26 so that end sections 20 and 24 are maintained in an approximately circular arc. Likewise, central section 22 is bent into an approximately circular arc when the tambourine 10 is assembled. The assembled tambourine 10 and assumes the shape of two intersecting arcs.

Jingle members 16 are mounted in twelve or fourteen jingle slots 34 as will be further described.

Figure 5:
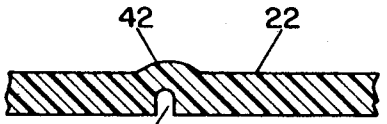
FIG. 5 is a detailed cross-sectional view of the FIG. 3 frame.
Figure 6:
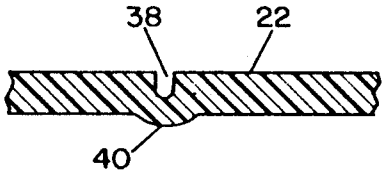
FIG. 6 is a detailed cross-sectional view of the FIG. 3 frame.
Figure 7:
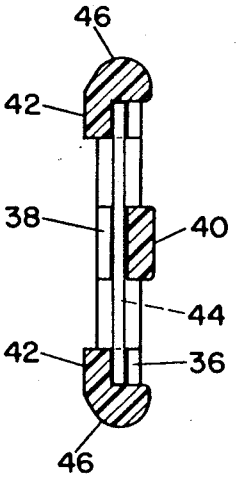
FIG. 7 is a detailed cross-sectional view of the FIG. 3 frame.
Figure 8:
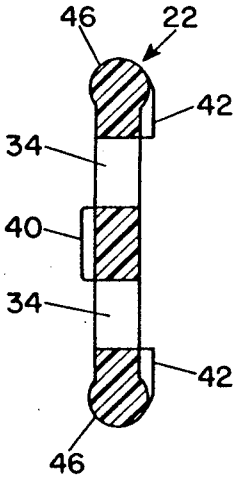
FIG. 8 is a detailed cross-sectional view of the FIG. 3 frame.

Details of the construction of frame member 12 are shown in FIGS. 3 through 8. In particular, the arrangement of hinges 18 is shown in the cross-sectional view of FIG. 4 which shows the hinges formed by a groove 35 in one side of frame 12 and a ridge 37 on the opposite side. Ridge 37 provides mechanical strength and maintains a uniform part thickness which is desirable for the molding process. FIGS. 5 and 6 show the arrangement of grooves for holding the jingle mounting pins 44.

Grooves 36 are formed on the transversely outer sides of slots 34 extending transversely and each intersecting one of slots 34. A central groove 38 is formed on the opposite side of frame 12 in axially alignment with grooves 36 in the space between transversely adjacent jingle slots 34. Groove 38 extends between and intersects the two adjacent slots. As shown in detail in FIG. 7 grooves 36 have closed ends for retaining the ends of jingle pin 44. The depths 48, 50 of grooves 36 and 38 respectively are selected so that the pin 44 can pass in a straight line between grooves 36 and 38 providing a three point support for the jingle pin 44. The outer surface of frame 12 include ridges 40 and 42 on the opposite side of grooves 38 and 36 respectively for reinforcing the frame against bending or breakage in the region of the grooves and maintaining uniform thickness for the frame molding process. Ridges 40 and 42 have an outward extension 52 corresponding to the depths 48, 50 of the grooves.

While the various embodiments illustrated provide for a three-point mounting for the jingle pins with two transversely adjacent jingle mounting slots 34, other arrangements are also possible. For example in the case of three jingle slots, four grooves can be provided in an outer groove—inner groove—inner groove—outer groove arrangement which provides two inner side grooves between two outer side grooves. Another possible arrangement is outer-inner-outer-inner. The essential objective is to provide a locking configuration having at least three alternating side grooves. The arrangements thus realized have a distinct advantage that there are no forces exerted on the pin by normal instrument play which would tend to move the pin out of its position.

Figure 9:
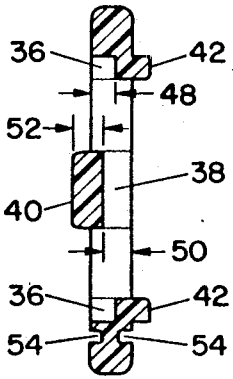
FIG. 9 is a cross-sectional drawing of an alternate arrangement for the FIG. 3 frame.
Figure 10:
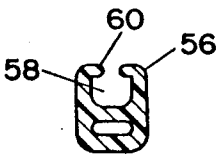
FIG. 10 is a cross-sectional drawing of a cushioning strip for use with the frame arrangement shown in FIG. 9.

In one embodiment of the invention, the transverse edges of frame 12 are provided with a rounded configuration 46 having a radius which is greater than one-half the thickness of the frame. This rounded and reinforced edge is more comfortable to the hand of a player when the tambourine is struck against the hand in a common playing technique. In addition this edge is particularly suitable for striking with a drumstick. In an alternate arrangement, shown in FIG. 9, grooves 54 extend longitudinally along the transverse edge of frame 12 for receiving a cushion strip 56 shown in FIG. 10. Strip 56 has a C-shaped cross-section so that the edges 60 of the C-shaped portion can be received in grooves 54. Strip 56 can be provided in material having varied durometer to suit the player of the instrument. A suitable range of durometer would be Shore A scale about 35 to 70. Alternately, strip 56 can be molded onto frame 12 in a second co-molding process.

Figure 11:
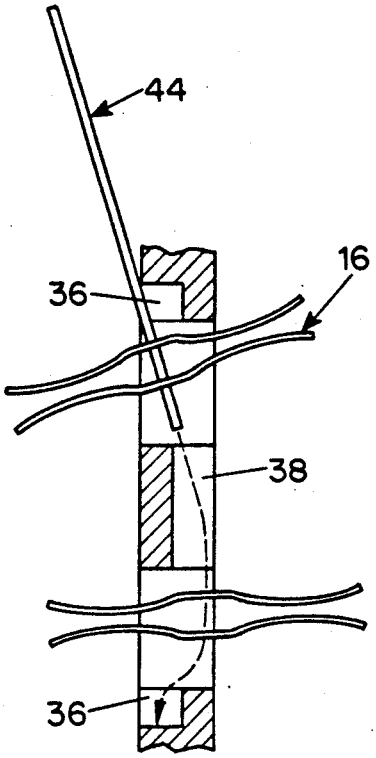
FIG. 11 is a simplified cross-sectional drawing of a frame illustrating the mounting of jingle members thereon.
Figure 12:
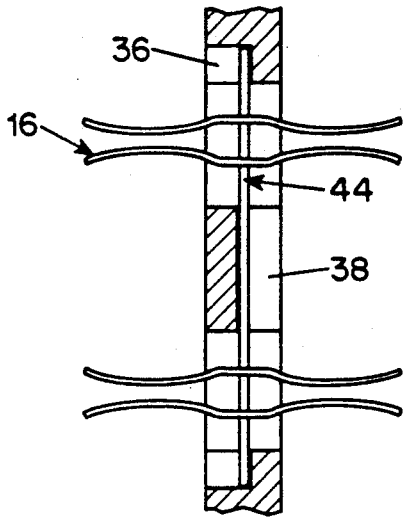
FIG. 12 is a simplified cross-sectional drawing of a frame showing jingle members in their mounted position.

FIGS. 11 and 12 illustrate how jingles 16 can be mounted in frame 12 using a spring pin 44. Pin 44 is inserted over groove 36 through a first set of jingles 16, through groove 38 then through a further set of jingles and into the opposite groove 36. During the insertion process, spring pin 44 is bent and then returns to the straight configuration shown in FIG. 12.

Figure 13:
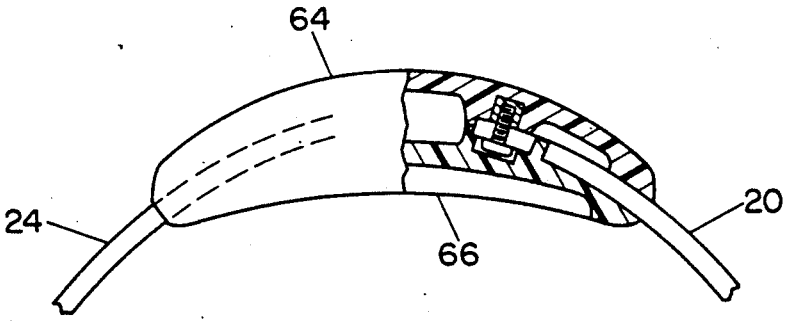
FIG. 13 is a top view, partially sectioned, illustrating an alternate connecting member in accordance with the invention.
Figure 14:
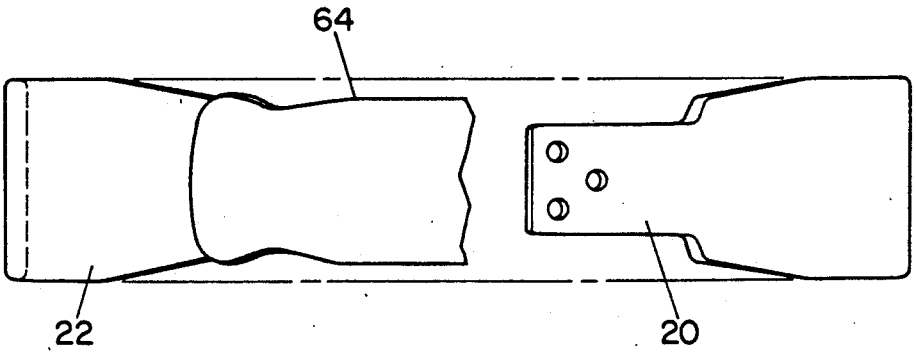
FIG. 14 is a rear view, partially sectioned, showing the arrangement of the alternate embodiment of FIG. 13.

FIGS. 13 and 14 show an alternate configuration wherein the connecting member comprises a contoured handle having a first handle member 64 which is connected to one side of end sections 20 and 24. A second handle portion 66 is placed over the other side of end sections 20 and 24 and attached to member 64, for example, by adhesive. Handle portion 66 can also be provided with a recess for accommodating a softer cushion pad on the inner side of the handle for comfort.

The tambourine according to the present invention provides a strong and durable construction with easy fabrication out of a single piece frame member. The jingle mounting configuration provides substantial restraints against jingle pin detachment and consequent loss of jingle.

The overall non-circular shape of the tambourine provides an easier and more comfortable distribution of the tambourine weight for extended and vigorous playing.

While there have been described what are believed to be the preferred embodiments of the invention, those skilled in the art will recognize that other and further modifications may be made thereto without departing from the spirit of the invention, and it is intended to claim all such changes and modifications as fall within the scope of the invention.

We claim:

1. A tambourine comprising jingle members mounted on a plastic frame, said frame being formed as an elongated web having first and second transverse hinges formed thereon, said hinges dividing said frame longitudinally into a central frame section and first and second end frame sections, said frame being folded at said hinges and curved longitudinally, and said frame ends being joined to a connecting member, whereby said frame is shaped generally into the form of intersecting arcs, a first arc formed by said central frame section and a second arc formed by said connecting member and said end frame sections.

2. A tambourine as specified in claim 1 wherein said hinges comprise transverse hinge grooves on said web dividing said frame sections.

3. A tambourine as specified in claim 2 wherein said hinges further include ridges on the surface of said web opposite said grooves.

4. A tambourine as specified in claim 1 wherein said connecting member comprises a contoured handle for holding said tambourine.

5. A tambourine as specified in claim 4 wherein said handle comprises a first handle member fastened to one side of each of said frame end sections and a second handle member mounted over the other side of each of said end sections.

6. A tambourine as specified in claim 1 wherein said connecting member comprises a mounting bracket for mounting said tambourine.

7. A tambourine as specified in claim 6 wherein said mounting bracket comprises first and second flange members connected to each other and angled with respect to each other at an angle corresponding to said second arc.

8. A tambourine as specified in claim 1 wherein said frame includes at least one transverse edge having a curved cross-sectional contour.

9. A tambourine as specified in claim 8 wherein said curved contour has a radius of curvature which is greater than one half the thickness of said frame, whereby said frame has enlarged thickness in the region of said edge.

10. A tambourine as specified in claim 1 wherein at least one transverse edge of said frame is provided with a cushioning edge strip.

11. A tambourine as specified in claim 10 wherein said cushioning edge strip comprises a longitudinal groove formed on each surface of said frame along said edge and an elongated cushioning strip having a C - shaped cross section mounted with the C edges engaging said longitudinal grooves.

12. A tambourine as specified in claim 1 wherein said jingles are mounted in longitudinal slots in said frame, and wherein at least two of said slots are arranged transversely adjacent each other on said frame and wherein said jingles are mounted by a pin arranged in at least two transverse grooves on one side of said frame and at least one transverse groove on the other side of said frame, said grooves having depths from their respective surfaces selected to maintain said pin in a substantially straight line, at least two of said grooves having closed ends for receiving the ends of said pin.

13. In a musical instrument having jingles, an arrangement for mounting said jingles to a jingle supporting frame comprising at least two jingle slots transversely adjacent each other on said frame and extending through said frame, at least two grooves on one side of said frame extending in said transverse direction and each intersecting at least one of said slots, at least one groove on the other side of said frame intersecting two of said slots, said grooves having depths selected to accommodate a pin passing through said grooves on both sides of said frame and two of said grooves having closed ends for retaining the ends of a pin with jingles mounted thereon and arranged in said slots.

14. A tambourine having a curved frame and jingles mounted to said frame, said frame having at least two jingle mounting slots transversely adjacent each other on said frame, at least three transverse grooves intersecting said slots and arranged on opposite sides of said frame on opposite sides of said slots, and a jingle mounting pin having jingles in said slots and mounted in said grooves, the ends of said pin being received in respective end slots having closed ends.

15. A tambourine as specified in claim 14 wherein said frame is reinforced in the region of said grooves on the side opposite said grooves.

* * * * *

UNITED STATES PATENT AND TRADEMARK OFFICE

CERTIFICATE OF CORRECTION

PATENT NO. : 5,040,446

DATED : August 20, 1991

INVENTOR(S) : Wayne E. Cohen et al.

It is certified that error appears in the above-identified patent and that said Letters Patent is hereby corrected as shown below:

On title page, item [56], include the following:

D268,419 dated 3-29-83 Taninbaum
587,561 dated 8-3-1897 Sherman
3,608,417 dated 9-28-71 Koishikawa
4,567,807 dated 2-4-86 Robinson
4,325,281 dated 4-20-82 Hardy
4,688,462 dated 8-25-87 Greenspoon et al.
3,779,126 dated 12-18-73 Hoey
3,620,118 dated 11-16-71 Koishikawa Col. 2, line 56, delete "and".
Col. 2 of patent is illegible.
Col. 3, line 4, "axially" should read --axial--.
Col. 3, line 13, "include" should read --includes--.

Signed and Sealed this

Ninth Day of March, 1993

*Attest:*

STEPHEN G. KUNIN

*Attesting Officer*

*Acting Commissioner of Patents and Trademarks*